US010285544B2

(12) United States Patent
Perlas et al.

(10) Patent No.: US 10,285,544 B2
(45) Date of Patent: May 14, 2019

(54) APPARATUS FOR MULTI DOSING OF WIPE AT POINT OF DISPENSING

(71) Applicant: The Clorox Company, Oakland, CA (US)

(72) Inventors: Kristina Perlas, Pleasanton, CA (US); Aidee Duarte, Pleasanton, CA (US); John Glauber, Pleasanton, CA (US); Joshua King Hoyt, Portland, OR (US); David John Sayler, Portland, OR (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 15/604,520

(22) Filed: May 24, 2017

(65) Prior Publication Data

US 2018/0338649 A1 Nov. 29, 2018

(51) Int. Cl.

| | |
|---|---|
| ***A47K 10/32*** | (2006.01) |
| ***A47L 13/50*** | (2006.01) |
| ***A47K 5/12*** | (2006.01) |
| ***A47K 10/30*** | (2006.01) |
| ***A47K 10/38*** | (2006.01) |
| ***A47K 7/03*** | (2006.01) |
| ***A47L 13/17*** | (2006.01) |

(52) U.S. Cl.

CPC ..... *A47K 10/32* (2013.01); *A47K 5/12* (2013.01); *A47K 5/1202* (2013.01); *A47K 5/1207* (2013.01); *A47K 7/03* (2013.01); *A47K 10/30* (2013.01); *A47K 10/3818* (2013.01); *A47L 13/17* (2013.01); *A47L 13/50* (2013.01); *A47K 2010/328* (2013.01); *A47K 2010/3273* (2013.01)

(58) Field of Classification Search

CPC ..... A47K 10/426; A47K 10/424; A47K 2010/3273; A47K 10/32; A47K 5/12

USPC ..... 221/96, 192, 102, 2; 206/233, 38, 449; 222/192, 321.7, 321.9, 383.1, 129

See application file for complete search history.

(56) References Cited

U.S. PATENT DOCUMENTS

| | | | | |
|---|---|---|---|---|
| 2,044,284 A * | 6/1936 | Dargavel | A47F 1/08 | 118/425 |
| 2,789,725 A * | 4/1957 | Carper | A47K 10/427 | 206/233 |
| 3,189,228 A * | 6/1965 | Steinbart | A61F 15/001 | 222/129 |
| 3,947,134 A * | 3/1976 | Ogawa | A47K 10/32 | 401/118 |

(Continued)

FOREIGN PATENT DOCUMENTS

| | | |
|---|---|---|
| CN | 103027622 B | 5/2015 |
| WO | 2018022621 A1 | 2/2018 |

*Primary Examiner* — Rakesh Kumar
(74) *Attorney, Agent, or Firm* — Erin Collins

(57) ABSTRACT

In one example, a wipe dispensing system includes a housing that defines an internal wipe storage area, a mixing element having an opening that communicates with the wipe storage area, a fluid reservoir disposed within the housing, a pump in communication with the fluid reservoir, a nozzle in communication with the pump and located proximate the opening of the mixing element such that an outlet of the nozzle is in communication with the opening of the mixing element, and a pump actuation mechanism operably connected with the pump and responsive to initiation of the dispensation of a wipe from the wipe dispensing system.

4 Claims, 13 Drawing Sheets

(56) References Cited

U.S. PATENT DOCUMENTS 3,980,203 A * 9/1976 Dearling ..... A47K 10/32 221/96
4,069,789 A * 1/1978 Fukagawa ..... B65H 35/0046 118/264
4,543,913 A * 10/1985 Wilkeson ..... A01K 13/003 119/603
4,598,664 A * 7/1986 Hamlin ..... A47K 10/32 118/32
4,667,846 A * 5/1987 Marceau ..... A47K 10/32 221/34
4,759,652 A * 7/1988 Ulrich ..... A45D 34/00 15/222
5,312,021 A * 5/1994 Nelson ..... A47K 10/32 221/96
5,439,104 A * 8/1995 Wolska-Klis ..... G02C 13/006 206/233
5,887,759 A * 3/1999 Ayigbe ..... A47K 10/32 118/325
5,988,371 A 11/1999 Paley et al.
6,021,919 A * 2/2000 Kelly ..... A61B 42/40 221/155
6,311,833 B1 * 11/2001 Collier ..... A45C 11/005 206/229
6,321,937 B1 * 11/2001 DeSimone ..... A47K 10/3818 221/45
6,601,737 B1 8/2003 Sandler
6,613,144 B1 * 9/2003 Loertscher ..... A47K 10/32 118/302
6,789,695 B1 * 9/2004 Gaudreau ..... A47K 10/424 206/449
7,018,473 B2 * 3/2006 Shadrach, III ..... A47K 10/3818 118/315
7,318,949 B2 * 1/2008 Shadrach, III ..... A47K 10/3818 118/315
7,370,754 B2 * 5/2008 Kushner ..... B08B 1/00 206/233
7,497,351 B2 * 3/2009 Amundson ..... A47K 10/421 221/135
7,654,412 B2 2/2010 Amundson et al.
7,984,832 B2 7/2011 Pivonka et al.
79,808,777 7/2011 Kennedy et al.
8,006,864 B2 * 8/2011 Fryan ..... A47K 10/32 206/233
8,256,644 B2 * 9/2012 Orgna ..... A47K 5/1202 221/45
2007/0289988 A1 12/2007 Sosalla et al.
2008/0138143 A1 6/2008 O'Connell
2008/0245821 A1 10/2008 Itzkowitz et al.
2008/0257906 A1 * 10/2008 Orgna ..... A47K 5/1202 221/303
2009/0032553 A1 * 2/2009 Eddy ..... A61L 9/12 222/192
2009/0090737 A1 * 4/2009 Franco ..... A47K 5/12 221/96
2010/0032338 A1 2/2010 Mueller et al.
2010/0032443 A1 * 2/2010 Mueller ..... A45D 34/00 221/2
2015/0173573 A1 6/2015 Dunn et al.
2015/0196173 A1 * 7/2015 Hoefte ..... A47K 5/1211 222/153.01
2015/0245747 A1 * 9/2015 Manfredonia ..... A47K 10/426 221/96
2015/0366416 A1 12/2015 Hoefte et al.
2017/0333586 A1 11/2017 Kang et al.
2018/0010080 A1 1/2018 Kang et al.

* cited by examiner

APPARATUS FOR MULTI DOSING OF WIPE AT POINT OF DISPENSING

RELATED APPLICATIONS

This application is related to U.S. patent application Ser. No. 15/604,497, entitled ON DEMAND WET WIPE DISPENSER, and filed the same day herewith. The aforementioned application is incorporated herein in its entirety by this reference.

FIELD OF THE INVENTION

Embodiments of the present invention generally concern disposable wipe dispensing devices and associated components and methods. More particularly, at least some embodiments of the invention relate to a dispensing device that separately stores disposable wipes from multiple interior reservoirs that each hold a respective fluid. The action of withdrawing a wipe from the dispensing device causes operation of respective pumps associated with each fluid reservoir so that fluid from each of the fluid reservoirs is directed onto the wipe as the wipe is being dispensed from the dispensing device.

BACKGROUND

Various wipe dispensing devices exist that store multiple wipes which can be dispensed one at a time by a user. Typically, the wipes are stored in the dispensing device pre-wetted with a fluid of some type. While this approach has been satisfactory in some respects, problems nonetheless remain in the art.

For example, the chemicals in the fluid used to pre-wet the wipes can degrade such that the efficacy of the fluid is reduced, or eliminated, with the passage of time. This is particularly likely to occur in the common circumstance where the wipes are dispensed only occasionally and the wipe fluid thus has a relatively long residence time in the dispenser.

A related problem is that, over time, the fluid and the wipe substrate may chemically interact with each other in such a way that the efficacy of the wipe and/or the fluid is compromised. Again, this problem may be of particular concern in the case where the wipes have a relatively long residence time in the dispenser.

As should be evident from the foregoing examples, another problem with typical wipe dispensing systems is that they lack flexibility in terms of the chemical formulations that can be employed. That is, typical wipe dispensing systems are constrained to a limited number of types of chemical formulations for the fluid, since the fluid is required to remain relatively efficacious over a long period of time, and cannot have adverse interactions with the wipe substrate material. Corresponding restrictions are imposed on the wipes as well. That is, the wipes must be made of a substrate material that does not significantly degrade when exposed to the fluid for long periods of time.

Typical wipe dispensing systems lack flexibility in other regards as well. For example, it is sometimes the case that a fluid combination is relatively more efficacious than its individual components considered separately. However, such fluid combinations may be efficacious for only a limited period of time. Consequently, it may not be practical to use wipes pre-wetted with such fluid combinations in typical wipe dispensing systems, since the fluid on the wipe may reside in the dispensing system for a period of time longer than its useful life.

In light of problems such as those noted above, it would be useful to provide a wipe dispensing system that enables use of various combinations of fluids. It would also be useful to provide a wipe dispensing system that enables relatively long term storage of the wipes and fluids without material degradation of either.

ASPECTS OF AN EXAMPLE EMBODIMENT

Embodiments within the scope of the invention may be effective in overcoming one or more of the problems in the art, although it is not required that any embodiment resolve any particular problem(s). In general, embodiments of the present invention concern disposable wipe dispensing systems and associated components and methods. More particularly, at least some embodiments of the invention relate to a dispensing device that separately stores disposable wipes from multiple interior reservoirs that each hold a respective fluid. The action of withdrawing a wipe from the dispensing device causes operation of respective pumps associated with each fluid reservoir so that fluid from each of the fluid reservoirs is directed onto the wipe as the wipe is being dispensed from the dispensing device.

In one example embodiment, a wipe dispensing system is provided that is configured to hold wipes and one or more fluids in such a way that the wipes and each of the one or more fluids can be stored in isolation from the others within a housing of the wipe dispensing system. Some more particular embodiments include the wipes and fluids. The wipe dispensing system further includes one or more pumps disposed within the housing, and each pump is configured and arranged to pump a respective one of the fluids when the fluid is present in the housing. The pumps are configured and arranged to operate substantially simultaneously. A pump actuation mechanism is operably connected with the pumps and with a container in which the wipes are stored such that in response to initiation of the dispensation of a wipe from the container, the pump actuation mechanism is operated and causes the pumps to each dispense a respective fluid onto the wipe as the wipe is dispensed.

Advantageously then, this example embodiment of the invention is directed to a wipe dispensing system configured to operate such that the wipes are dosed with one or more fluids at the point of dispensation from the wipe dispensing system. Moreover, only a single action, that is, initiation of the dispensation of the wipe, is needed to both dispense and dose the wipe at the same time. Further, the wipe is dosed with each of the fluids at the same time. Finally, each of the fluids, as well as the wipes, can be stored within a respective container of the wipe dispensing system so that all of the fluids and wipes are isolated from each other until the time that a wipe is dispensed.

BRIEF DESCRIPTION OF THE DRAWINGS

In order to describe the manner in which at least some aspects of this disclosure can be obtained, a more particular description will be rendered by reference to specific embodiments thereof which are illustrated in the appended drawings. Understanding that these drawings depict only example embodiments of the invention and are not therefore to be considered to be limiting of its scope, some example embodiments of the invention will be described and explained with additional specificity and detail through the use of the accompanying drawings, in which.

DETAILED DESCRIPTION OF SOME EXAMPLE EMBODIMENTS

Reference will now be made in detail to aspects of various embodiments of the present disclosure, examples of which are illustrated in the accompanying drawings. While described in conjunction with these embodiments, it will be understood that they are not intended to limit the disclosure to these embodiments.

A. General Aspects of Some Example Embodiments

Figure 1:
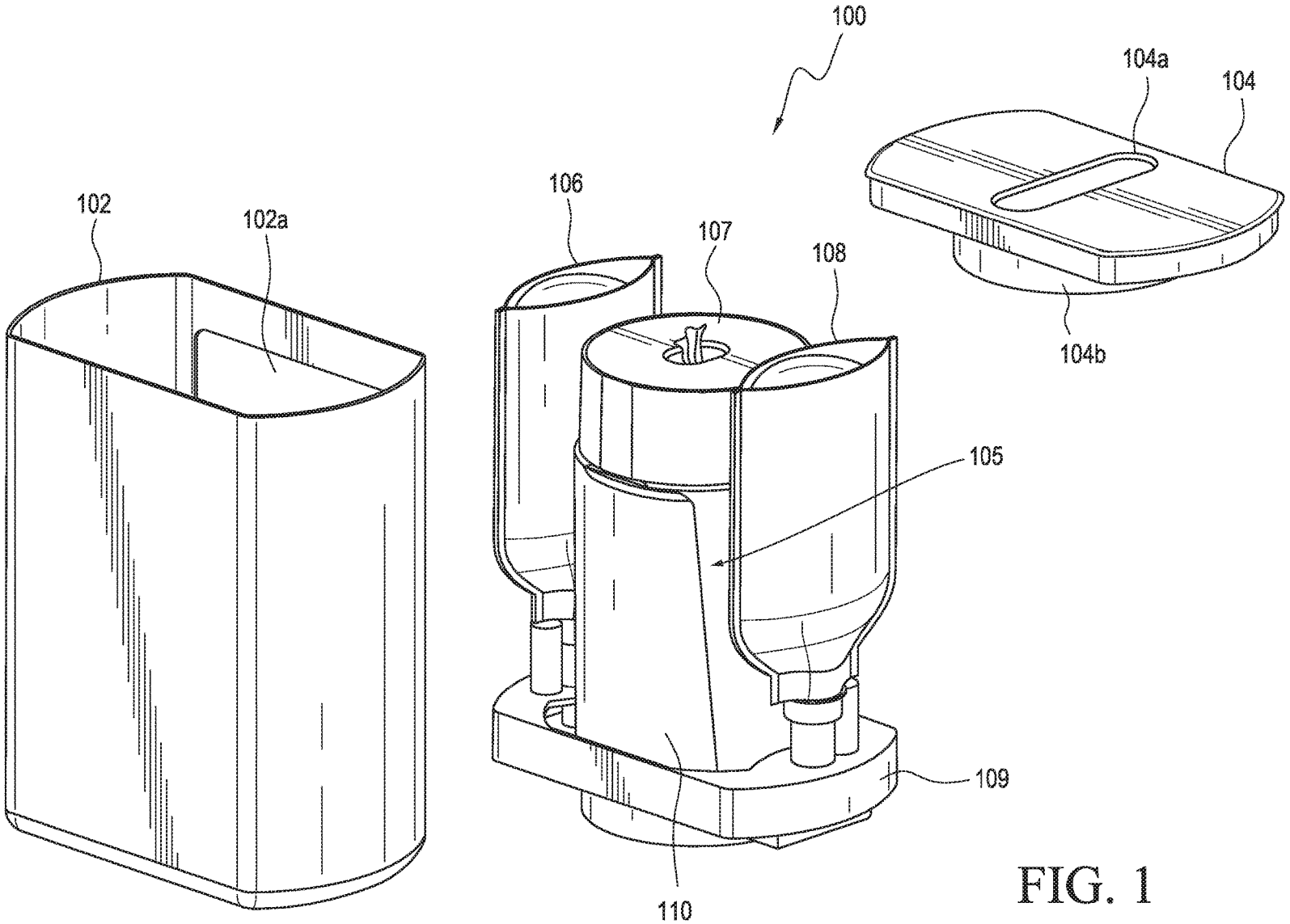
FIG. 1 is an exploded perspective view of an example wipe dispensing system.
Figure 2:
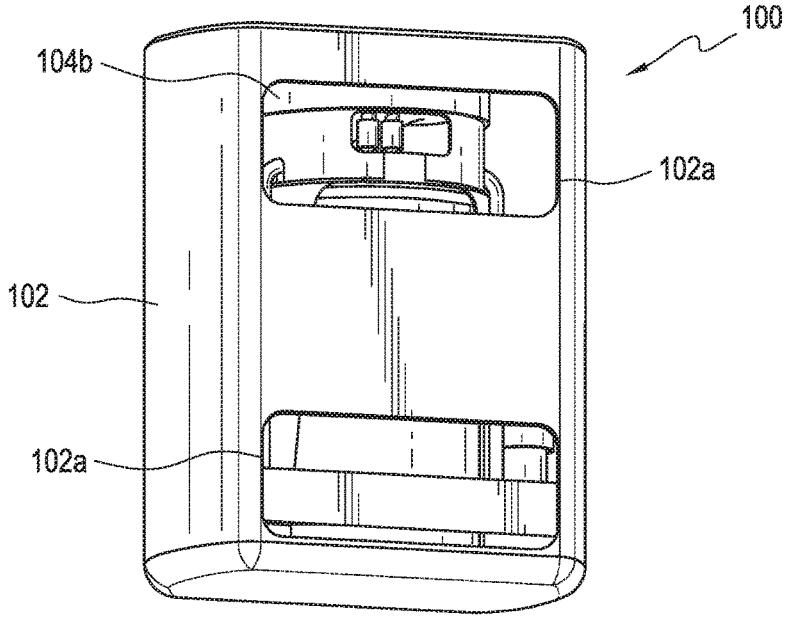
FIG. 2 is a perspective view of an example wipe dispensing system.

Directing attention now to FIGS. 1 and 2, details are provided concerning a wipe dispensing system, one example of which is denoted generally at 100. In general, various materials can be used in the construction of components of the wipe dispensing system 100. Examples of such materials include, but are not limited to, plastic, metal, Teflon® (PTFE), nylon, and rubber.

In more detail, the wipe dispensing system 100 includes a housing 102, and a lid 104 configured to mate with the housing 102. The housing 102 and lid 104 can be made of plastic and/or any other suitable material(s). As shown in FIG. 1, the housing 102 and lid 104 are removable from the wipe dispensing system 100 so as to enable refilling of wipes and fluids. In other embodiments, the wipe dispensing system 100 can be a single use system that can be discarded or recycled after the wipes and/or fluids have been exhausted.

The housing 102 and lid 104 can each include various elements. For example, the housing 102 can include one or more windows 102*a* which can enable access to, and/or viewing of, components disposed in the interior of the housing 102. While not specifically illustrated, the housing 102 can be configured, such as with fasteners and/or other components, to be wall mounted, tabletop mounted, or free-standing. As well, the lid 104 includes a slot 104*a* by way of which wipes (not shown) can be dispensed from the wipe dispensing system 100, and the lid 104 further includes a protruding circular wall 104*b* configured to interface with a mixing bowl frame (discussed below).

With continued reference to FIG. 1 in particular, the wipe dispensing system 100 is configured to store, within the housing 102, both wipes and one or more fluids that can be used to dose the wipes. In the particular, and non-limiting, example of FIG. 1, the wipe dispensing system includes a first fluid reservoir 106 and a second fluid reservoir 108. It should be understood that in other example embodiments, one of which is disclosed herein and discussed below, only a single fluid reservoir is provided. In still other example embodiments, more than two fluid reservoirs are provided. More generally, any number 'n' (where 'n'≥1) of fluid reservoirs can be provided in various other embodiments. In some alternative embodiments, one or both of the fluid reservoirs 106 and 108 can be located on the exterior of the housing 102.

The fluid reservoirs 106 and 108 are isolated from each other so that the respective fluids stored in those reservoirs 106 and 108 do not mix with each other unless and until they are dosed onto a wipe. Put another way, the fluid reservoirs 106 and 108 are not in fluid communication with each other but instead comprise elements of respective, independent, fluid systems. The independent fluid systems, discussed in more detail below, are configured such that any mixing of the fluids prior to dosing is substantially, or completely, foreclosed. This arrangement may be advantageous as it permits the use of fluid combinations, unavailable in conventional systems, which may remain efficacious for only a short period of time after its component fluids are combined with each other. As well, the component fluids may retain their potency for a relatively longer period of time when stored separately from each other.

With continued reference to FIG. 1, the wipe dispensing system 100 is further configured to store a supply of wipes 110 within the housing 102. Storage of both the wipes 110 and fluids within the housing 102 enables a relatively compact, self-contained, assembly that is easy to use and maintain.

In some embodiments, the supply of wipes 110 can be in the form of a roll, such as a continuous roll for example, where perforations are provided between successive wipes so that the wipes can be retained together during manufacturing, but easily separated as they are dispensed. In these embodiments, the roll that includes the wipes 110 can be positioned on end within the housing 102, as shown in FIG. 1. As well, the roll and wipes 110 can be configured so that wipes are successively dispensed beginning at the center of the roll. This configuration of the wipes 110 is provided only by way of example however, and any other configuration of a group of multiple wipes that is compatible with the dispensing and dosing functionalities disclosed herein can alternatively be used.

It will be apparent from the foregoing discussion of FIG. 1 that the wipes 110 are isolated from the respective fluids contained in the fluid reservoirs 106 and 108 unless and until the wipes 110 are dosed with those fluids. Thus, in embodiments of the invention, the wipes 110 and the fluids are all stored in isolation from each other until the time that the wipe is dosed with the fluids. This storage arrangement for wipes and fluids employed in embodiments of the invention may be advantageous in a variety of regards.

To illustrate, isolation of the wipes and fluids permits the use of fluids and fluid combinations that may otherwise degrade, and/or be degraded by, the wipe substrate material if, as is typically the case in conventional wipe dispensing systems, the wipe and fluid(s) were stored in contact with each other for a relatively long period of time. Likewise, wipe substrate materials can be used that would otherwise degrade, and/or be degraded by, the fluid(s) if, as is typically the case in conventional wipe dispensing systems, the wipe and fluid(s) were stored in contact with each other for a relatively long period of time. As well, fluid combinations including fluids that, when combined, may be efficacious only for a relatively short period of time can be used since those fluids are not combined with each other until dosed onto a wipe. Such fluid(s)-wipe combinations enabled by embodiments of the invention may be relatively more efficacious than the fluid-wipe combinations employed in conventional wipe dispensing systems and/or may provide functionality and results previously unattained in conventional wipe dispensing systems. Thus, embodiments of the invention can enable, or provide, a wide range of combinations of wipes and fluid(s), many, if not all, of which are not available or even feasible in conventional wipe dispensing systems.

As further indicated in FIG. 1, the example wipe dispensing system 100 includes a mixing bowl frame 105 that includes a bowl cover 107 and partially houses the wipes 110. Finally, a pump frame 109 is provided that generally supports one or more fluid pumps. The aforementioned components, and others, are discussed in more detail below.

B. Aspects of an Example Fluid System

With continued attention to FIG. 1, and directing attention now to FIGS. 3*a*-3*e*, details are provided concerning fluid dispensing systems employed in various embodiments of the invention, where one example of such a fluid dispensing system is denoted generally at 200. In general, the fluid dispensing system 200 includes multiple fluid reservoirs, such as fluid reservoirs 202 and 204, each configured to hold a volume of fluid and isolated from each other so that fluid in one of the fluid reservoirs cannot enter the other fluid reservoir. The fluid reservoirs 202 and 204 can take various forms, such as flexible bladders or pouches, or rigid containers, for example, and the fluid reservoirs 202 and 204 are configured and arranged so that the volumes of fluid contained in the fluid reservoirs 202 and 204 have a static pressure head imposed by gravity when the wipe dispensing system 100 is oriented as shown in FIG. 1. As well, the fluid reservoirs 202 and 204 can be removable from the wipe dispensing system 100 for refilling or disposal.

The fluid dispensing system 200 further includes multiple pumps, such as pumps 206 and 208. Each pump 206 and 208 is arranged for fluid communication with a respective fluid reservoir 202 and 204. In general, the pumps 206 and 208 serve to pump fluid from the fluid reservoirs 202 and 204, respectively, to a location where the fluids are dosed onto a wipe. Any suitable pump can be employed, and the pump and its components can be made of any material(s) compatible with the fluid to be pumped, examples of which include any type of plastic. In one example embodiment, one or both of the pumps 206 and 208 is a rolling diaphragm pump, examples of which are manufactured by Bellofram (www.bellofram.com). Details concerning these example pumps are disclosed in Appendix A hereto (Bellofram Rolling Diaphragm Design Manual), which is incorporated herein in its entirety by this reference. Pumps made by other manufacturers could alternatively be used however and, as well, any other pumps of comparable functionality could be substituted for the rolling diaphragm pumps.

Figure 3A:
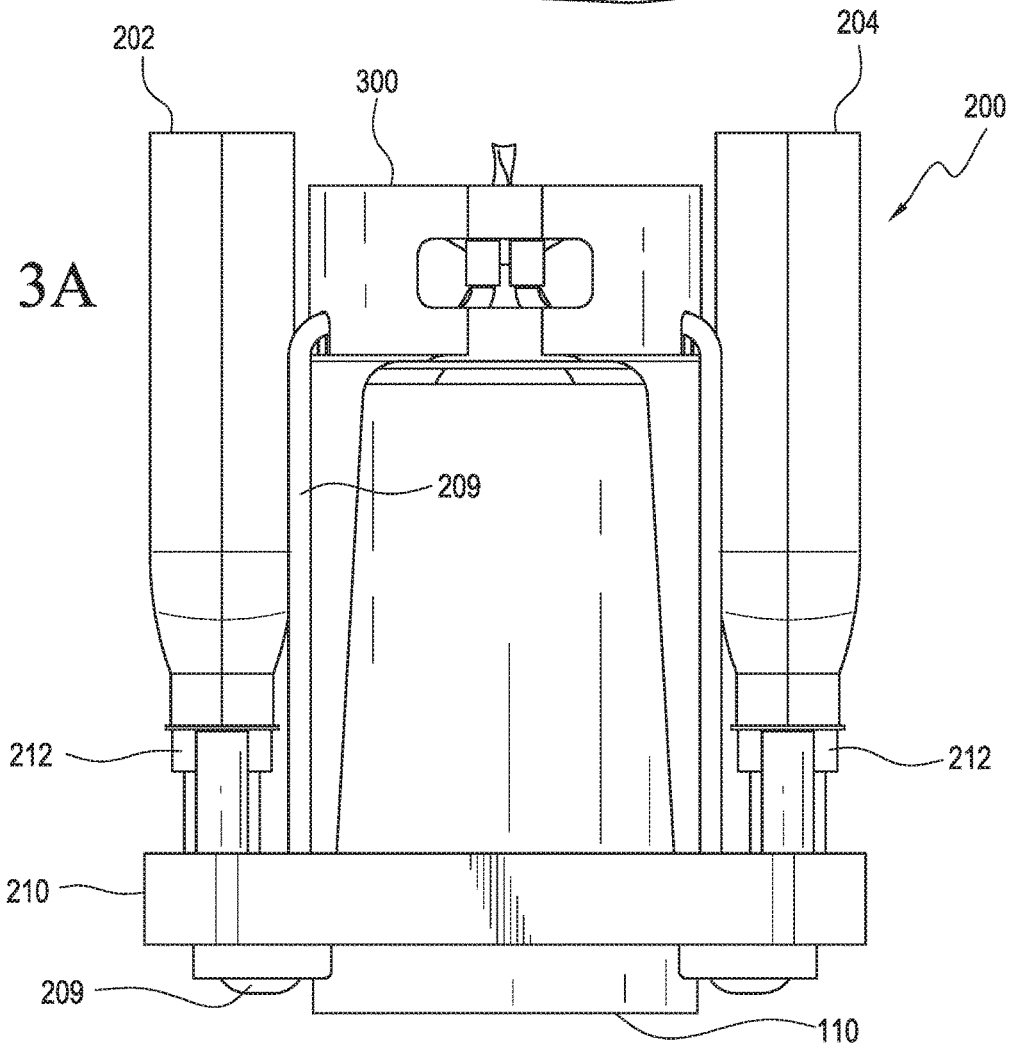
FIG. 3*a* is a side view of an example wipe dispensing system.
Figure 3B:
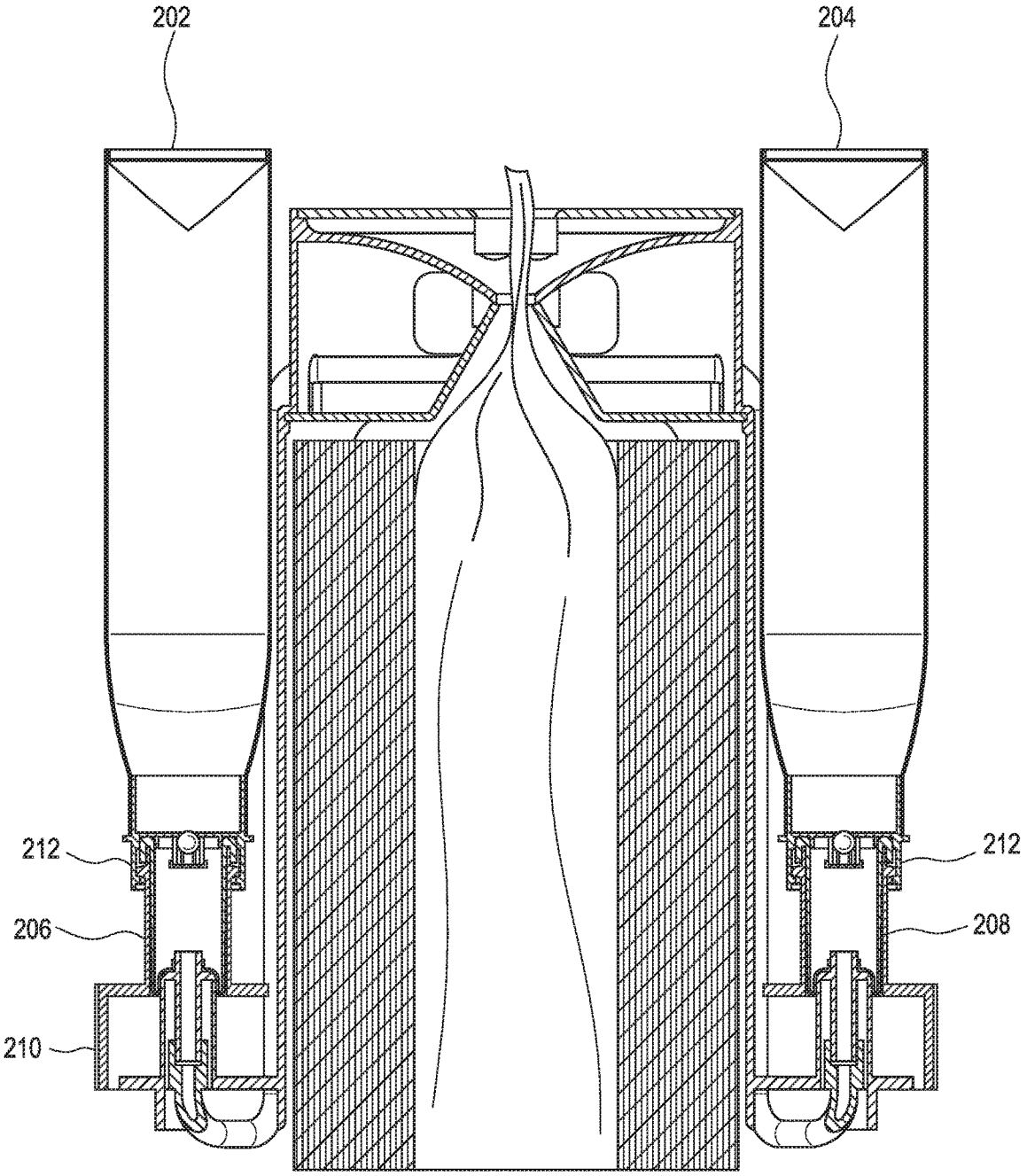
FIG. 3*b* is a section view taken from FIG. 3*a;*
Figure 3C:
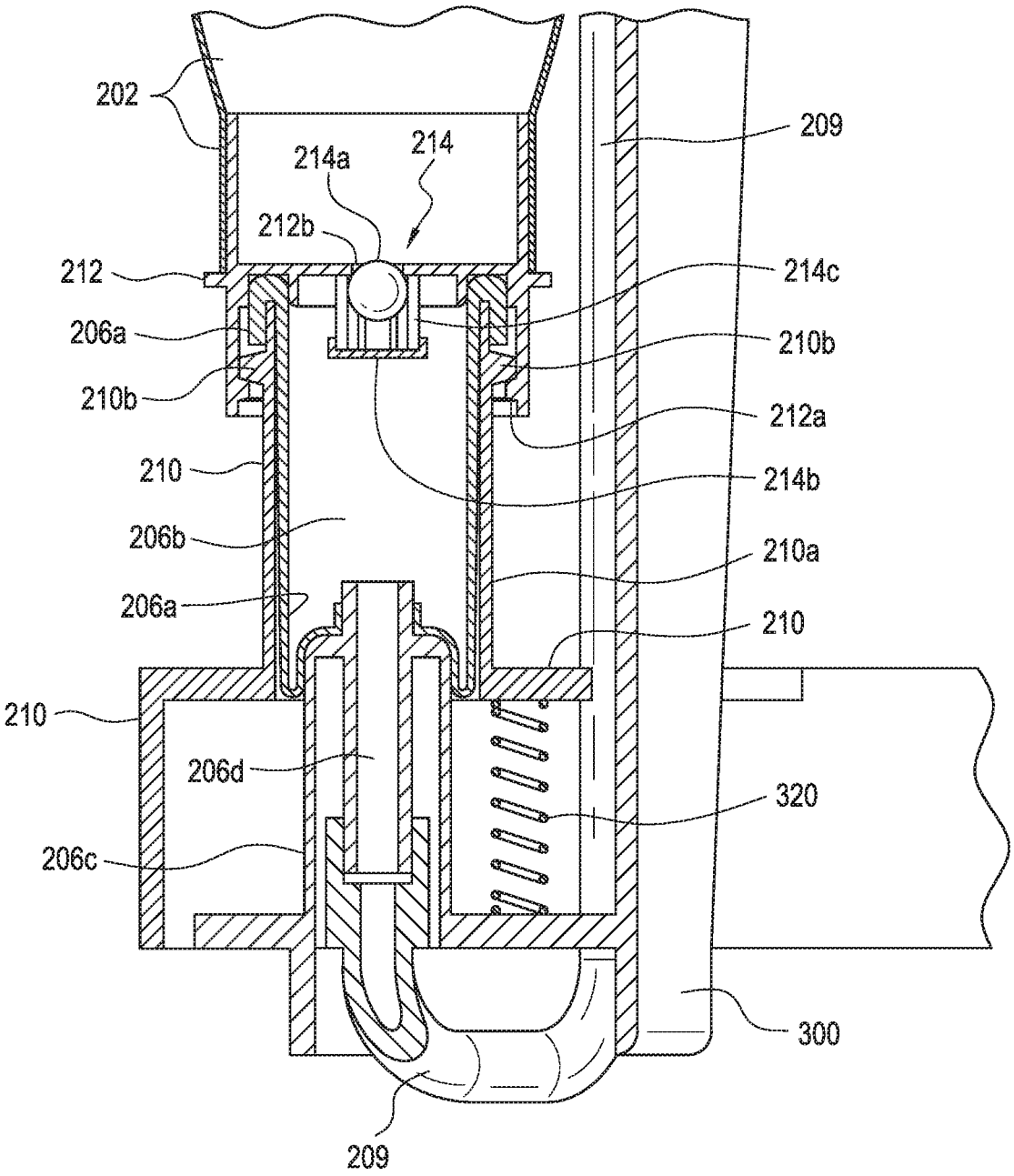
FIGS. 3*c* and 3*d* are a detail section views of an example pump.
Figure 3D:
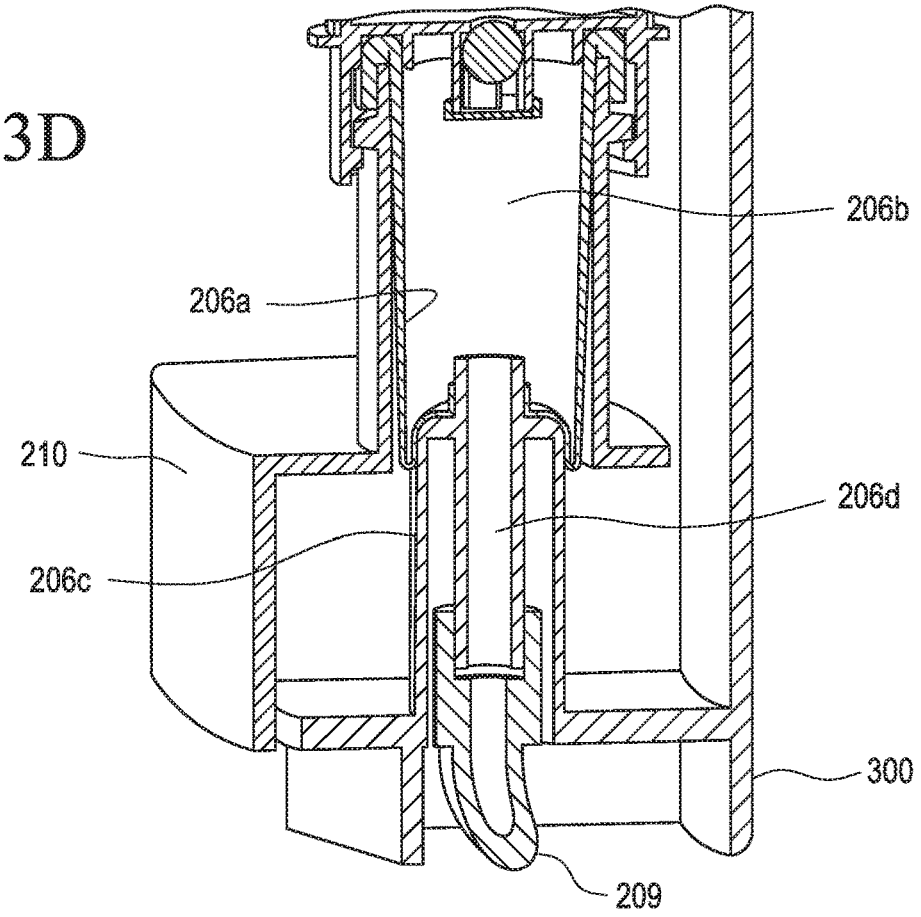
Figure 3E:
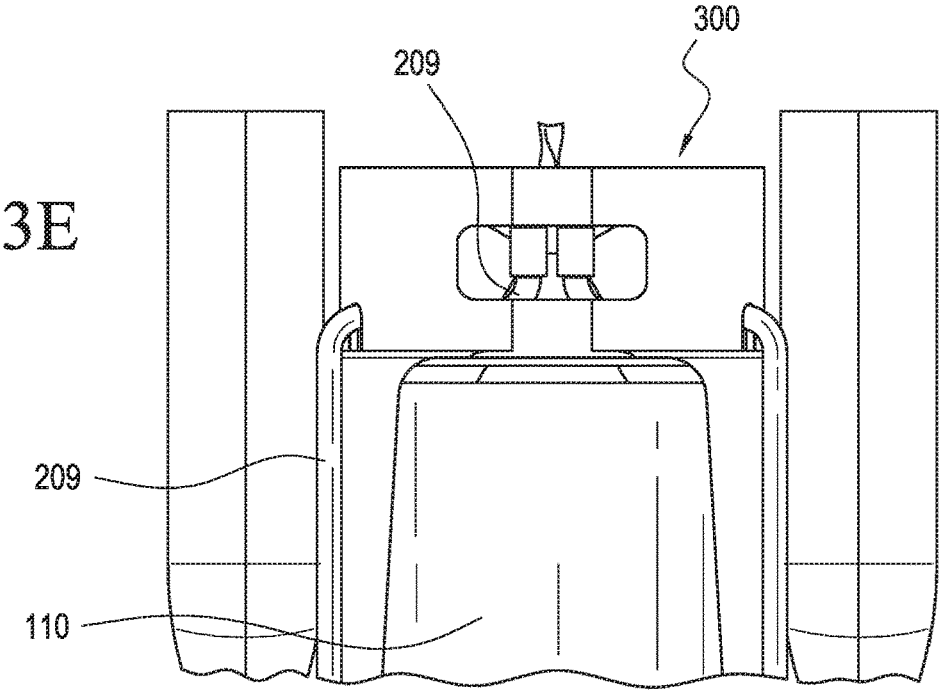
FIG. 3*e* is a partial side view of an example wipe dispensing system.

In some particular embodiments, and with reference to the example pump 206 of FIGS. 3*c* and 3*d* in particular, one or more of the pumps can take the form of a diaphragm pump which, in general, moves fluid from the fluid reservoir 202 through a discharge line by reciprocal motion of a flexible diaphragm 206*a*. In particular, the diaphragm 206*a* defines a fluid chamber 206*b* of variable volume, and the diaphragm 206*a* is connected to a piston 206*c* configured and arranged for reciprocal motion (up and down in FIG. 3*c*) so that as the piston 206*c* moves back and forth, the volume of the fluid chamber 206*b* changes in response. The piston 206*c* includes a fluid passageway 206*d* that communicates with the interior of the fluid chamber 206*b* and with a fluid conduit 209 that is connected to the piston 206*c*.

In the illustrated example embodiment, the lower end of the diaphragm 206*a* is attached to the piston 206*c*, while the upper end of the diaphragm 206*a* is connected to a pump frame 210 and, more particularly, is substantially disposed within a housing 210*a* defined by the pump frame 210. As shown, a portion of the pump frame 210 is engaged with a spout 212 to which the reservoir 202 is attached. An upper end of the pump frame 210 includes threads 210*b* configured to engage corresponding threads 212*a* of the spout 212 so that the spout 212, and attached fluid reservoir 202, can be releasably connected/disconnected to/from the pump frame 210. In some example embodiments, the spout 212 and pump frame 210 can be connected and disconnected with a relatively short turn, such as about 90 degrees for example.

The spout 212 further includes a check valve 214 that can control fluid communication between the chamber 206*b* and the fluid reservoir 202. Other types of backflow preventers could be used in place of the check valve 214. In the illustrated example, the check valve 214 includes a ball 214*a* movably confined within a housing 214*b*. When the ball 214*a* is positioned as shown in FIG. 3*c*, the ball 214*a* blocks an opening 212*b* of the spout 212 so that fluid flow between the reservoir 202 and the chamber 206*b* is prevented. When the ball 214*a* moves to a position in the housing 214*b* where the opening 212*b* is no longer blocked, fluid can flow between the reservoir 202 and chamber 206*b* by way of one or more openings 214*c* in the housing 214*b*. Further details concerning the operation of the pump 206 and associated components are disclosed elsewhere herein.

With continued reference to FIGS. 3*a*-3*e*, it can be seen that the fluid conduit 209 extends upward and interfaces with a mixing bowl frame, one example of which is denoted generally at 300 and disclosed in FIGS. 4*a*-4*e*. The mixing bowl frame 300 can be made of any suitable material, including plastic. The mixing bowl frame 300 can at least partly define a wipe storage area for a supply of wipes 110 which may be stored in a rolled up form.

Among other things, the mixing bowl frame 300 is connected to the piston 206*c* so that reciprocal motion of the piston 206*c* can be effected with a corresponding motion of the mixing bowl frame 300. The mixing bowl frame 300 and piston 206*c* can be integrally formed with each other, although that is not necessarily required.

Figure 4A:
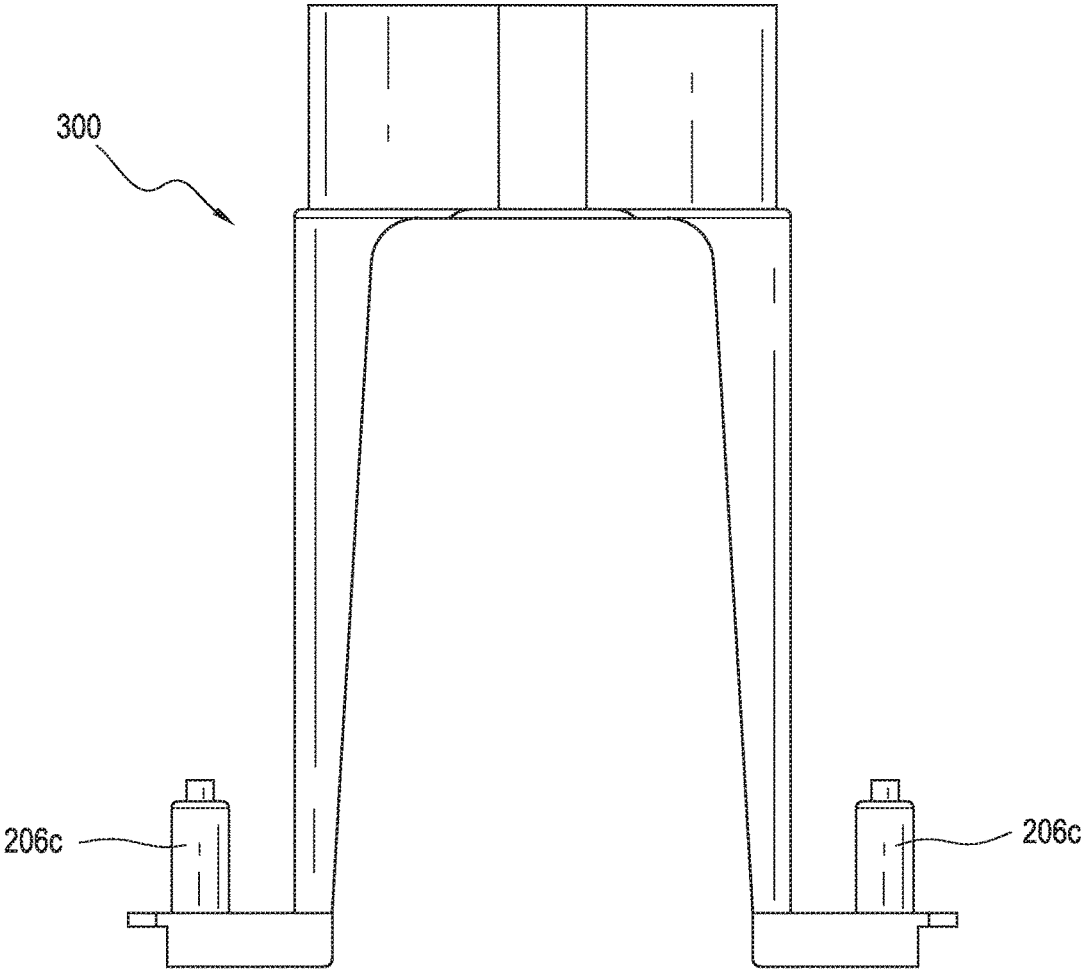
FIG. 4*a* is a side view of an example mixing bowl frame.
Figure 4B:
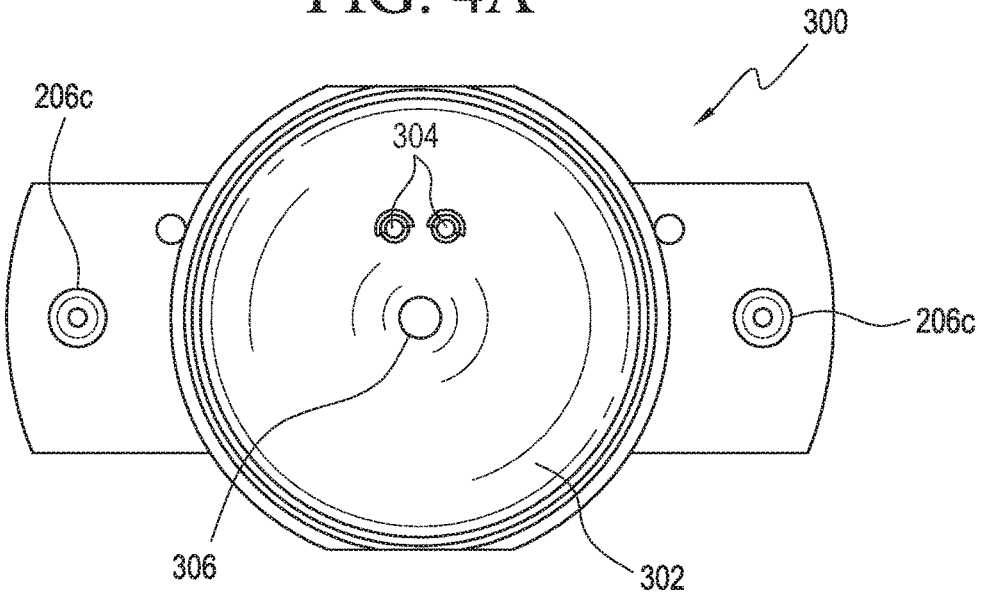
FIG. 4*b* is a top view of an example mixing bowl frame.
Figure 4C:
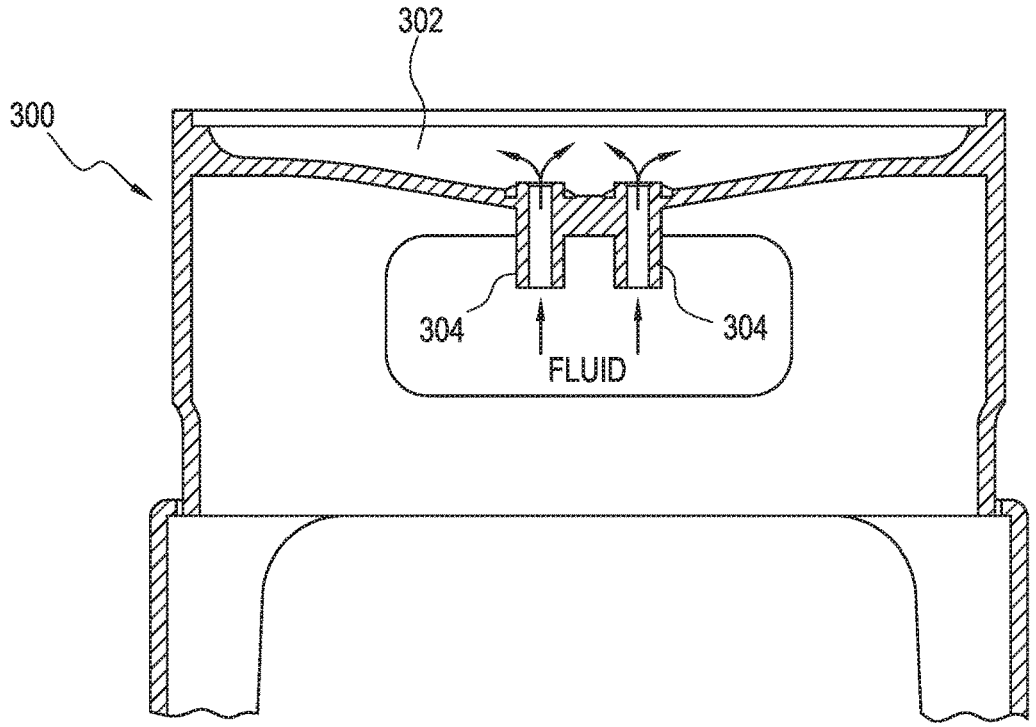
FIG. 4*c* is a partial section view of an example mixing bowl frame.

As indicated in FIGS. 4*b* and 4*c* for example, the mixing bowl frame 300 includes a mixing bowl 302 that communicates with fluid connections 304 that can be integral with the mixing bowl 302. In this way, fluid exiting each of the fluid connections 304 enters the mixing bowl 302 where the fluids are partly, or completely, mixed before being dosed onto a wipe as the wipe exits the dispenser opening 306. Aspects of the mixing bowl such as the size (depth and diameter) and shape can be selected as desired. For example, various different embodiments of a mixing bowl can be configured such that a portion of the mixing bowl has a parabolic shape, elliptical shape, or a spherical shape. In at least some embodiments, the mixing bowl is coated with, or comprises, a hydrophobic material that may help to reduce the amount of fluid from the nozzles that remains in the mixing bowl.

Figure 4D:
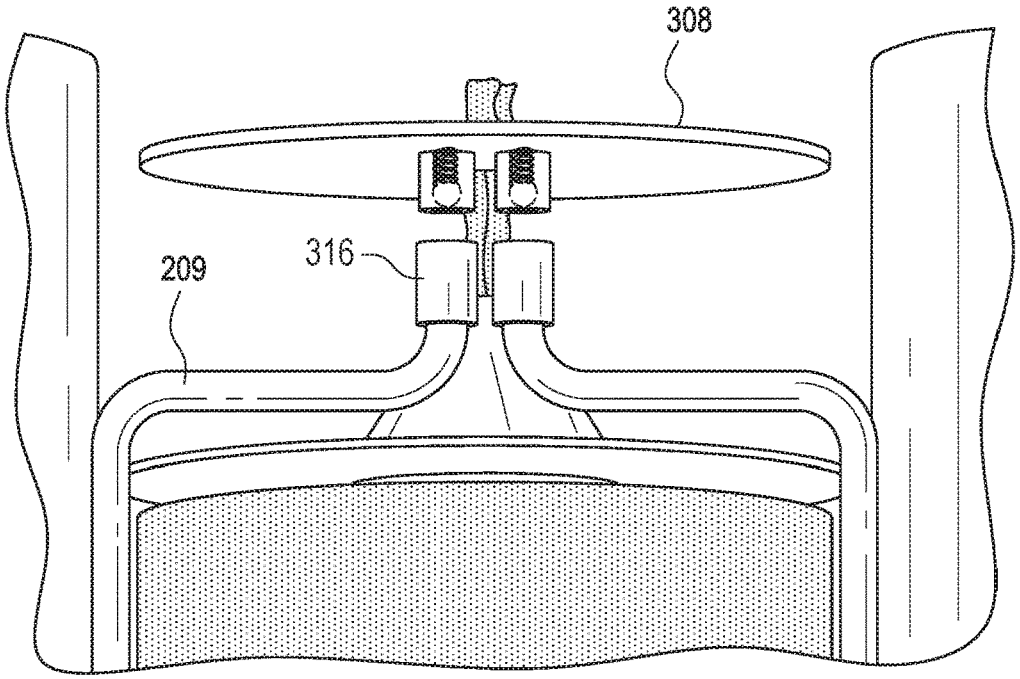
FIG. 4*d* is a partial perspective view of an example fluid dispensing system.
Figure 4E:
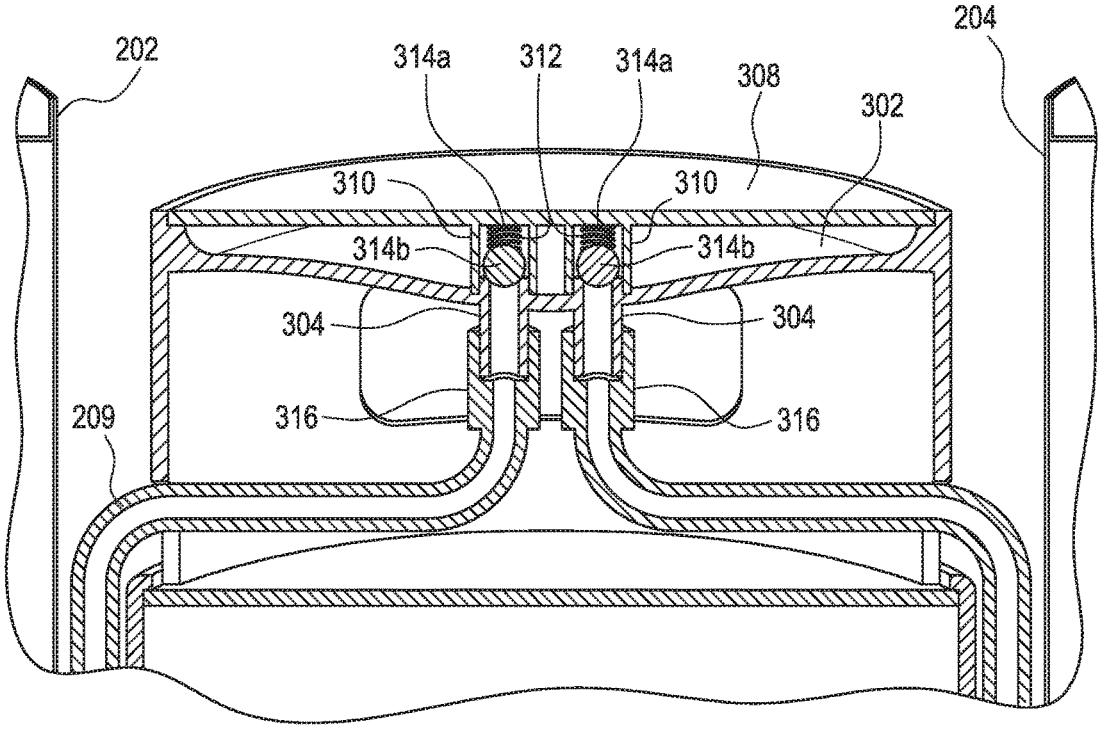
FIG. 4*e* is a partial section view of an example fluid dispensing system.

With reference now to FIGS. 4*d* and 4*e*, a mixing bowl cover 308 is provided that aids in preventing the escape of fluids present in the mixing bowl 302, and also prevents entry of foreign matter into the mixing bowl 302. The mixing bowl cover 308 can include an opening 308*a* (see, e.g., FIG. 5*b*) by way of which wipes 110 can be dispensed. As shown, the edges of the opening 308*a* can be radiused or otherwise configured to prevent damage to the wipes 110 as they are being dispensed.

The mixing bowl cover 308 can be removable from the mixing bowl frame 300 and includes one or more nozzles 310 that each include a nozzle outlet 312 configured for fluid communication with the mixing bowl 302. Each of the nozzles 310 houses a check valve 314 that comprises a biasing element 314*a*, such as a spring, and a ball 314*b*. The biasing element 314*a* biases the ball 314*b* into a closed position, that is, a position where the ball 314*b* blocks a fluid passageway 304 so that flow between the fluid conduit 209 and the nozzle outlet 312 is prevented except when the fluid conduit 209 is sufficiently pressurized with fluid from the fluid reservoir 202.

Aspects of the nozzles 310 such as the configuration, number, orientation, size of nozzle outlet, shape of nozzle outlet, and position can be selected as desired. Two or more nozzles can be the same as each other, or may differ from each other in one or more of the aforementioned aspects. For example, in some embodiments, two or more nozzles can be placed adjacent to each other so that neither nozzle is contaminated with fluid from the other. Alternatively, two nozzles, or groups of nozzles can be diametrically opposed to each other. Advantageously, and as shown in FIGS. 4*d* and 4*e* for example, a nozzle can be positioned relative to the mixing bowl such that no back flow, that is ingestion of fluid into the nozzle, from any other nozzles can occur.

In general, one or more nozzles can be configured and arranged, relative to a wipe dispensing path, such that fluid from the nozzles is distributed relatively evenly on a wipe as the wipe is dispensed. This even distribution can avoid disparities in concentration of the fluids on the wipe, and thus contribute to the relatively consistent performance of the wipe when it is employed by the user.

As another example, the nozzles can be arranged to point downward toward the bottom of the mixing bowl or, alternatively, the nozzles can be arranged to direct a stream of fluid substantially horizontally. As a further example, the relationship Q=VA (volume rate=velocity×area) can be used to select a size of the nozzle outlet that will enable a particular velocity for a given volume of fluid exiting that nozzle outlet per unit time.

In this latter circumstance, the pressure of the fluid in the fluid conduit 209 overcomes the bias imposed by the biasing element 314*a* so as to move the ball 314*b* upward, thus unblocking the fluid passageway 304 and allowing fluid to flow from the fluid conduit 209 into the mixing bowl 302 by way of the nozzle outlet 312. When the pressure of the fluid in the fluid conduit 209 decreases sufficiently, the biasing element 314*a* returns the ball 314*b* to a position where the ball 314*b* blocks the fluid passageway 304.

A fluid connection between the fluid conduit 209 and the fluid passageway 304 can be effected by way of a sleeve 316. As shown in FIG. 4*e*, the sleeve 316 can be sized and configured to receive a portion of the fluid conduit 209, and a lower end of the fluid passageway 304. An upper end of the fluid passageway 314 (see, e.g., FIG. 4*c*) can be received in the nozzle 310, as shown in FIG. 4*e*.

C. Aspects of Fluid System Actuation Mechanism

Figure 5A:
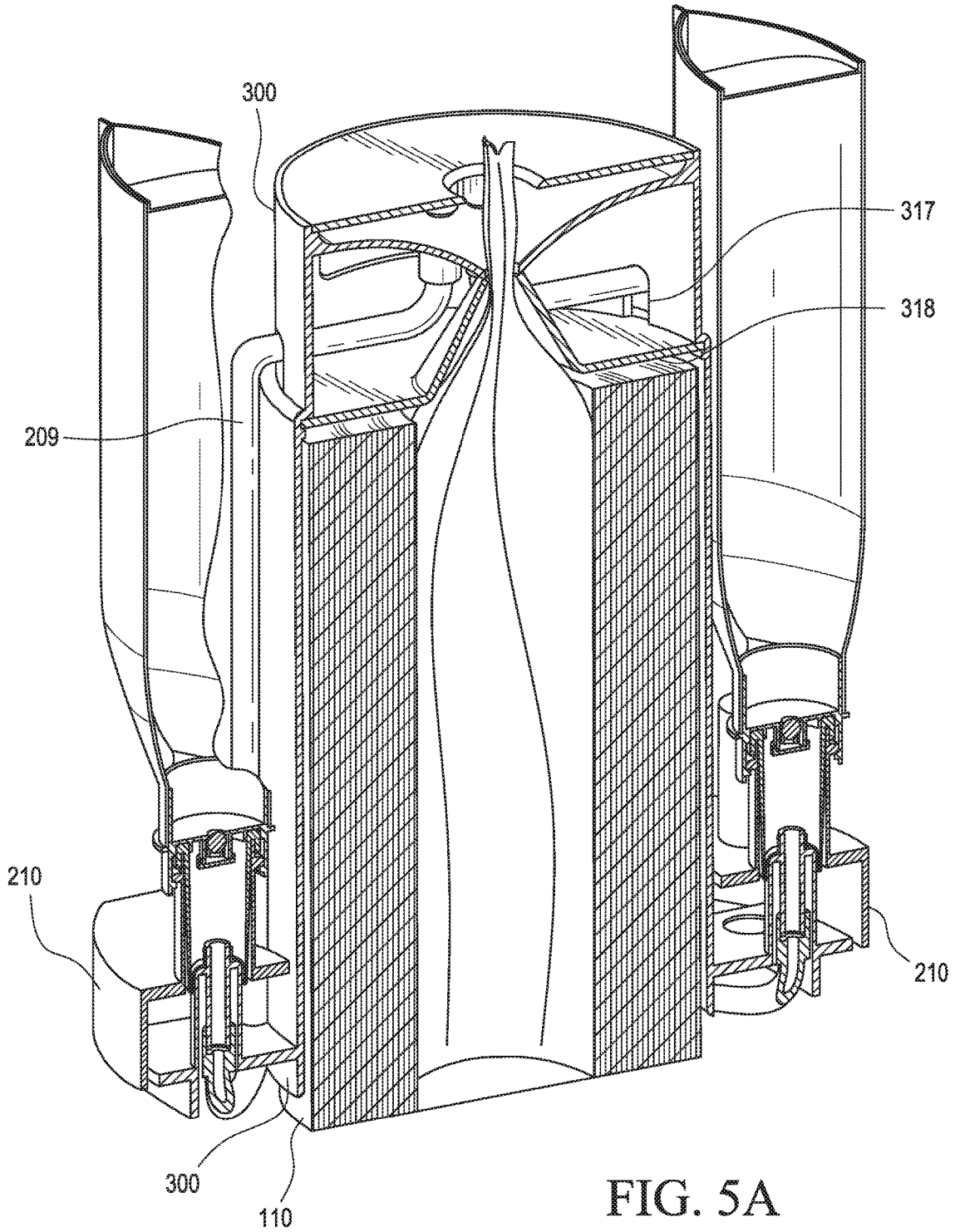
FIG. 5*a* is a section view of an example fluid dispensing system pump frame and mixing bowl frame.
Figure 5B:
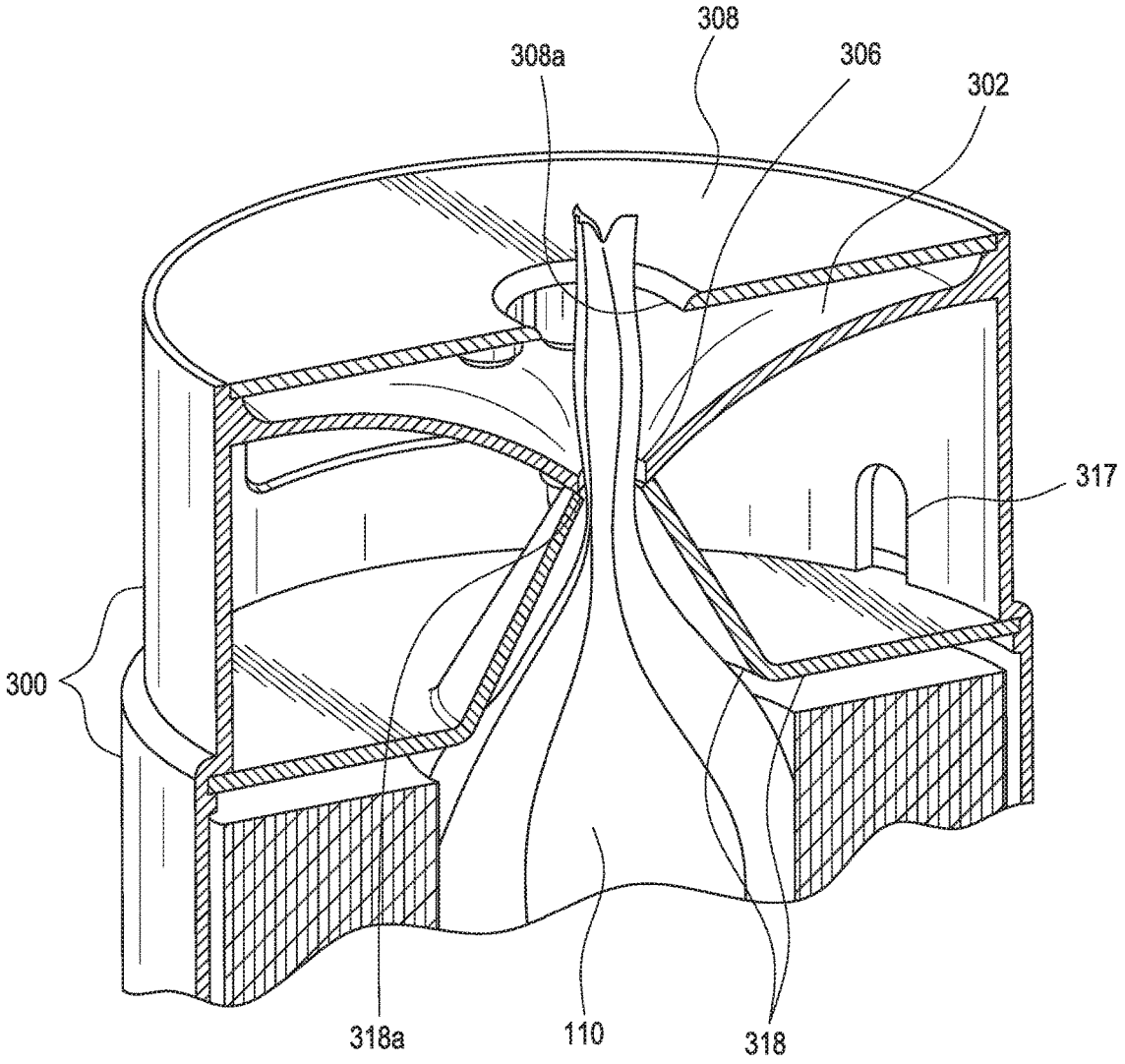
FIG. 5*b* is a partial section view of an example mixing bowl.

With continued attention now to FIGS. 3*c*, 3*d*, and 4*a*, and directing attention as well to FIGS. 5*a* and 5*b*, details are provided concerning the mixing bowl frame 300 as it concerns the operation of the pumps 206 and 208. For the sake of clarity, the following discussion will refer primarily to pump 206, but it should be understood that such discussion is equally germane to pump 208 and, moreover, the pumps 206 and 208 can be operated simultaneously in connection with the mixing bowl frame 300.

As best shown in FIGS. 3*c* and 3*d*, the mixing bowl frame 300 is connected to the piston 206*c*. Thus, motion can be imparted to the piston 206*c* by moving the mixing bowl frame 300. More specifically, the piston 206*c* can be moved up and down, so as to pump fluid from the reservoir 202 to the mixing bowl 302, by moving the mixing bowl frame 300 up and down. In various embodiments of the invention, this motion of the mixing bowl frame 300 can, in general, be effected by dispensing a wipe 110 from the wipe dispensing system. The mixing bowl frame 300 can include one or more openings 317 which enables the mixing bowl frame 300 to move relative to the fluid conduits, including fluid conduit 209.

In more detail, and with particular reference to FIGS. 5*a* and 5*b*, the mixing bowl frame 300 includes a funnel 318 disposed in the interior of the mixing bowl frame. As shown, the funnel 318 is oriented in an inverted manner and includes an opening 318*a* located proximate the dispenser opening 306. In at least some embodiments, the opening 318*a* takes the form of a circular orifice, although other geometries could be used. The inverted orientation of the funnel 318 enables the funnel 318 to serve as a guide for wipes 110 being dispensed from the wipe dispensing system. The opening 318*a* and/or the dispenser opening 306 can be sized to present resistance to the movement of the wipes 110 out of the wipe dispensing system. This relatively tight fit, which can be an interference fit, may also help to ensure that fluids present in the mixing bowl 302 are absorbed by a wipe 110 before those fluids can exit the mixing bowl 302 and drip onto the supply of wipes 110 stored beneath the funnel 318. Thus, in some instances, the discharged fluid(s) can accumulate in the mixing bowl 302 and then be absorbed by the wipe 110 as the wipe 110 passes through the mixing bowl 302.

For example, one or both of the opening 318*a* and the dispenser opening 306 can be small in diameter, relative to a diameter of a wipe 110 when the wipe 110 is configured and oriented as shown in FIG. 5*b*. In some embodiments, the magnitude of the resistance presented to the wipes 110 can be increased with the addition of a device having a relatively high coefficient of friction, such as a rubber ring disposed about the opening 318*a* and/or the dispensing opening 306. Rubber, silicone, or similar resilient materials, may be particularly useful as they can provide a relatively high level of resistance to the wipe 110 without damaging or otherwise compromising the integrity of the wipe 110 as it is dispensed.

In general, any device(s) and/or configuration(s), such as the aforementioned examples of rings and small diameter openings such as circular orifices, that resist dispensation of a wipe 110 to the extent that dispensation of the wipe 110 results in the upward movement of the mixing bowl frame 300, may be referred to herein as constituting a resistance element. Such resistance elements are example structural implementations of a means for resisting wipe dispensation. The foregoing structures are provided only by way of example however, and any other structure(s) of comparable functionality may alternatively be employed.

Among other things, and as noted, one function of such a means for resisting wipe dispensation is to cause movement of the mixing bowl frame 300 as the wipe 110 is dispensed. In particular, such a means may cause a lifting upward of the mixing bowl frame 300 as the wipe 110 is dispensed. As noted herein in the discussion of the pumps 206 and 208, this upward motion of the mixing bowl frame 300 operates the pumps 206 and 208 such that fluid from a reservoir 202 is withdrawn from the fluid reservoir 202 and pumped to the mixing bowl 302, as described elsewhere herein. That is, the pumps 206 and 208 are automatically operated in response to movement of the mixing bowl frame 300. After a volume of fluid, which can be a fixed volume, is dispensed from the fluid reservoir 202, the mixing bowl frame 300 can return to the position shown, for example, in FIG. 3*c* in preparation for the next wipe 110 dispensing event.

With regard to the volume of fluid dispensed during a wipe dispensing event, that volume can be a function of a number of variables, including the pressure exerted by the pump, the internal diameter of the fluid conduit, and the volume of the fluid chamber. By appropriately selecting the fluid system components, a relatively high degree of accuracy can be obtained with regard to the amount of fluid dispensed. As well, the duration of time over which the fluid is dispensed can be about the same amount of time it takes for a wipe to be completely dispensed from the wipe dispensing system (e.g. 10 seconds or less, about 0.001 seconds to 5 seconds, 0.1 seconds to 3 seconds, etc.). Further, the wipe dispensing system can dispense fluid during an entire wipe dispensing event or during only part of the wipe dispensing event. The amount of time taken by the dosing process can be adjusted in various ways such as, for example, by adjusting the dose amount. Thus, a relatively small dose amount may be dispensed before the wipe dispensing event is completed, while a relatively larger dose amount may be dispensed during all, or nearly all, of the wipe dispensing event. Moreover, the fluid dispensing system can be configured so that dosing of the wipe is completed before the wipe is completely dispensed. In this way, there is adequate time for the wipe to absorb all of the dispensed fluid, thereby helping to ensure that there is no fluid remaining that could drip downward onto the supply of wipes that have not yet been dispensed.

As well, variables such as the pressure, velocity, and flow rate of the fluid can vary depending upon the rate at which the wipe is dispensed. For example, if the wipe is gradually dispensed at a relatively consistent rate, the pressure, velocity and flow rate of the fluid may likewise be relatively consistent over the wipe dispensation process. On the other hand, if the wipe is dispensed at a rate that varies, the pressure, velocity and flow rate of the fluid may correspondingly vary over the wipe dispensation process. For example, those parameters may start at relatively low values and then quickly move to higher values if the wipe is dispensed quickly. Thus, regardless of the manner in which the wipe is dispensed during a wipe dispensing event, the wipe dispensing system is able to respond and adjust to the wipe dispensing event and adequately dose the wipe with the fluid(s).

With continued reference now to the Figures, simply the weight of the mixing bowl frame 300 may be adequate in some embodiments to return the mixing bowl frame 300, under the influence of gravity, to the position indicated in FIG. 3*c*. In other embodiments, one or more biasing elements 320 such as springs for example can be configured and arranged to bias the mixing bowl frame 300 into the position shown in FIG. 3*c*. By way of illustration, and with continued reference to FIG. 3*c*, one or more biasing element(s) 320 can be provided that is positioned between the pump frame 210 and mixing bowl frame 300 so that the biasing element 320 tends to bias the mixing bowl frame 300 downward into the position shown in FIG. 3*c*. Where such a biasing element 320 is provided, the resistance offered by the resistance element 320 should be such that, in a dosing operation, the mixing bowl frame 300 could move upward to overcome the bias imposed by the biasing element 320 in response to the initiation of dispensation of a wipe 110, but the resistance offered by the resistance element should not be so great that damage, such as tearing for example, would occur to the wipe 110 during the dispensing and dosing process.

As explained in the present disclosure, including the foregoing discussion concerning operation of the pumps 206 and 208, the combination of the mixing bowl frame 300 and one or more of the pumps 206 and 208 is an example structural implementation of a means for automatic dosing of a wipe, with one or more fluids, at the point of dispensing of the wipe. Moreover, such a means functions to dose the wipe as the wipe is being dispensed. The foregoing structures are provided only by way of example however, and any other structure(s) of comparable functionality may alternatively be employed.

When a means for resisting wipe dispensation is provided in the mixing bowl frame, the mixing bowl frame constitutes an example structural implementation of a means for simultaneously operating multiple pumps. The foregoing structures are provided only by way of example however, and any other structure(s) of comparable functionality may alternatively be employed.

Various aspects of the fluid dispensing system can be modified to achieve corresponding effects. For example, in one illustrated embodiment, each pump has the same size and configuration and is activated at about the same time by the mixing bowl frame. However, in other embodiments, different pump types and pump arrangements can be employed to achieve other effects. For example, the pumps can be selected and arranged to provide for sequential dosing of two or more fluids on a wipe during a wipe dispensing process. In more detail, the pumps can be configured and arranged to be operated in sequence by a single motion of the mixing bowl frame. Such effects can additionally, or alternatively, be achieved with modifications to the size and configuration of the mixing bowl frame. As another example, variables such as the piston diameter and stroke length can be varied to change the flow rate at which a fluid is dispensed, as well as the volume of the dispensed fluid.

D. Operation of a Fluid Dispensing System

With reference to the various Figures discussed above, details are now provided concerning some operations of an example wipe dispensing system. While the following discussion refers to a single pump and fluid reservoir, the described operations can also be performed in connection with multiple pumps and respective fluid reservoirs and, as such, multiple fluids can be dosed onto a wipe substantially simultaneously. Alternatively, multiple fluids can be dosed onto the wipe one after another, but close in time (e.g. within 10 seconds or less of one another, within 5 seconds or one another, etc.). In another embodiment, the multiple fluids may be mixed immediately prior to being dosed on the wipe (e.g. mixing fluids within 5 minutes or less of being dosed on wipe, mixing fluids within 2 minutes or less of being dosed on wipe, mixing within 30 seconds or less of being dosed on a wipe, etc.).

Initially, the wipe dispensing system can be in a 'ready' state where the wipe dispensing system is able to dispense a wipe on demand. See, e.g., FIG. 3*c*. In the 'ready' state, a portion of the wipe may extend out of the opening defined in the mixing bowl cover so that the wipe can be readily grasped by a user. Finally, in the 'ready' state, a fluid chamber associated with the pump may be partly, or completely, filled with a fluid that is to be dosed onto a wipe, and part of an associated fluid conduit downstream of the fluid chamber and downstream of an associated pump may also be filled with the fluid.

The fluid chamber and/or other components of the pump can be sized to provide a dose of a particular volume. Where multiple pumps and fluid chambers are provided, the dose volume provided by each can be the same, or may be different. Because the pumps can provide relatively precise dosage amounts, the ability to select dose sizes and, thus, dosing ratios for multiple fluids, enable the chemistry of a particular fluid, or combination of fluids, to be tuned, for example, to a desired pH, color, and/or concentration. For example the ratio of the first fluid to the second fluid maybe 20:1 to about 0.1:1, 10:1 to about 1:10, 5:1 to about 0.5:5, 2:1 to about 1:1, etc.

In any case, the user can then grasp the wipe and begin to pull the wipe from the wipe dispensing system. In response to initiation of the dispensation of the wipe, the wipe begins to move out of the wipe dispensing system. Due to the configuration and arrangement of the resistance element, movement of the wipe out of the dispensing system causes a corresponding upward movement of the mixing bowl frame.

Because the mixing bowl frame is connected, directly or indirectly, to one or more pump pistons, the pump piston moves upward in unison with the mixing bowl frame. This upward motion of the pump piston, to which the diaphragm is attached, exerts pressure on the fluid in the fluid chamber, causing the check valve in the spout to seal the fluid chamber so that fluid in the fluid chamber cannot enter the fluid reservoir. Under the influence of the pressure exerted by the upward movement of the piston, the fluid in the fluid chamber thus exits the fluid chamber by way of the fluid passageway of the piston. Because the fluid passageway is connected to the nozzle in the mixing bowl by a fluid conduit, the fluid passing out of the fluid chamber flows through the fluid conduit to the nozzle, and the nozzle directs the flow of fluid onto the wipe as the wipe is exiting the wipe dispensing system, and/or the fluid is directed by the nozzle into the mixing bowl where the fluid then comes into contact with the wipe as the wipe passes through the mixing bowl.

Dosing of the wipe may be completed at about the same time that the wipe has been substantially, or completely, dispensed from the wipe dispensing system. Thus, after most or all, of the pressurized fluid dose has exited the nozzle, the wipe may have been completely dispensed from the wipe dispensing system, and the mixing bowl frame then freely returns to the 'ready' state described above. As well, depressurization of the fluid dispensing system, occurring as a result of discharge of the pressurized fluid from the nozzle, releases the back pressure on the check valve in the spout and as a result, fluid can freely flow from the fluid reservoir into the fluid chamber in preparation for the next wipe dispensing and dosing event.

E. Aspects of Some Example Methods

Figure 6:
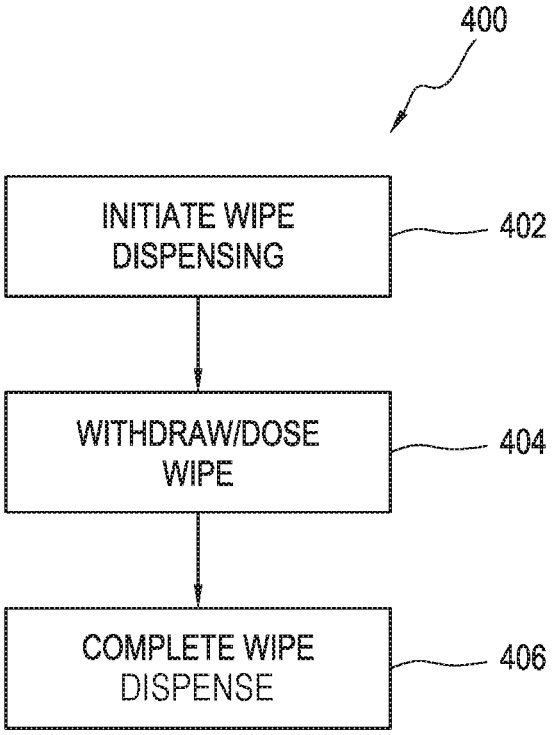
FIG. 6 is a flow diagram disclosing an example method of use for a wipe dispensing system.

With continued reference to the Figures, and directing attention now to FIG. 6, details are provided concerning a method of use of an example wipes dispensing system, where one example of such a method is denoted generally at 400.

The method 400 can begin when dispensation of a wipe is initiated 402. This initiation 402 can occur when, for example, a user grasps a portion of the wipe that protrudes from a wipe dispensing system and begins to withdraw the wipe from the wipe dispensing system. The wipe may be dry, or un-dosed, prior to the initiation 402 of the dispensation of the wipe.

After initiation 402 of the wipe dispensation, the user can continue to withdraw the wipe 404 from the wipe dispensing system. The wipe may be progressively dosed by one or more fluids as a result of the withdrawal of the wipe 404 from the wipe dispensing system. Thus, the process 404 can involve movement of a wipe that is wet in one portion, such as the portion that has been withdrawn from the wipe dispensing system, and dry in another portion, such as the portion that has not passed into the mixing bowl.

At 406, the user completes the dispensation of the wipe from the wipe dispensing system. For example, the user may have fully withdrawn the wipe from the wipe dispensing system. At this juncture, the wipe has been dosed with one or more fluids such that a substantial portion of the wipe has been wetted with the fluid(s). Thus, the process 406 can involve completion of the dispensation of a fully dosed wipe from the wipe dispensing system.

Figure 7:
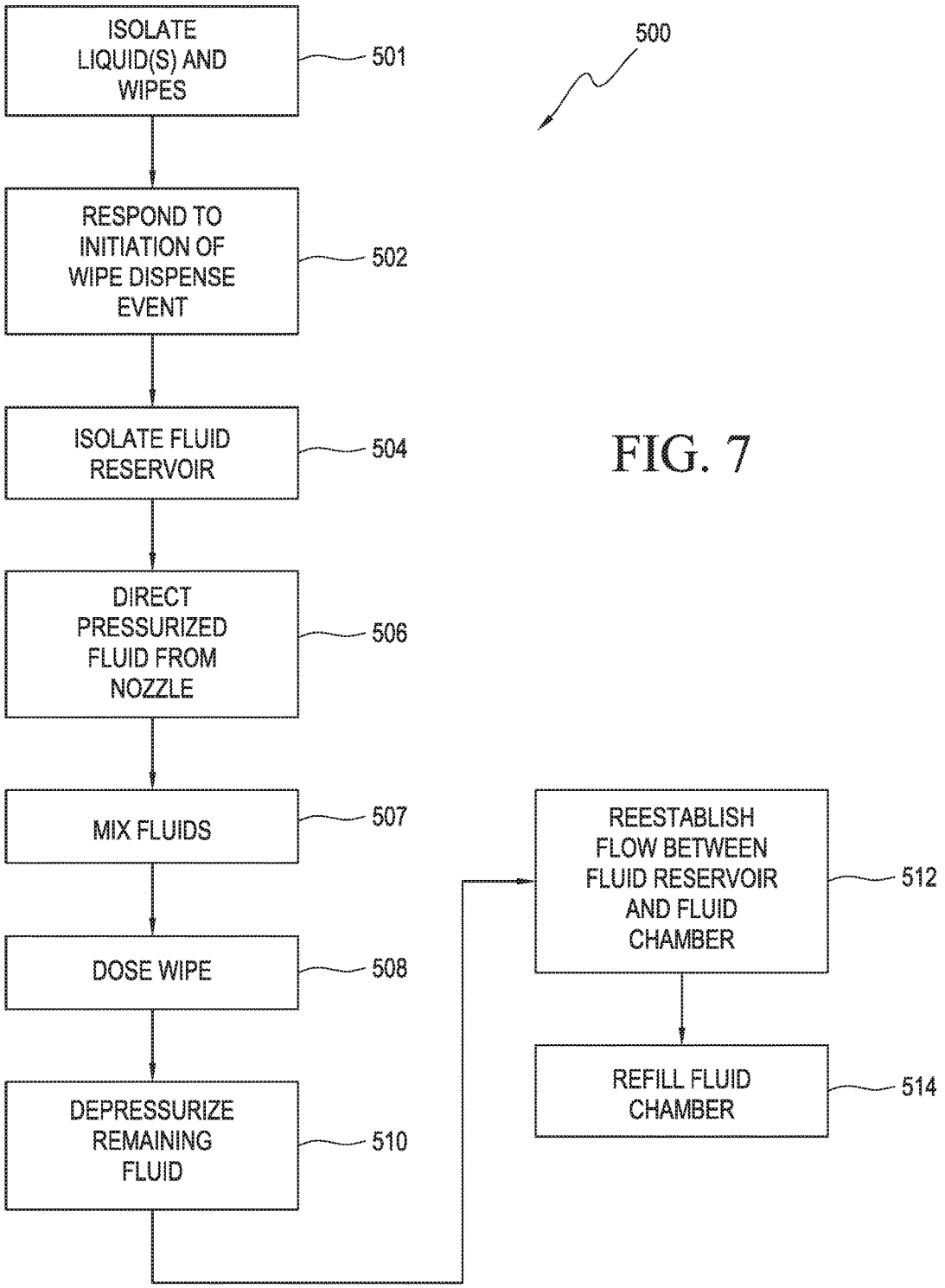
FIG. 7 is a flow diagram disclosing an example method of operation of a wipe dispensing system.

With continued reference to the Figures, and directing attention now to FIG. 7, details are provided concerning a method of operation of an example wipes dispensing system, where one example of such a method is denoted generally at 500. While the following discussion generally refers to a fluid dispensing system that includes a single pump and fluid reservoir, it should be understood that the method can involve the operation of multiple fluid dispensing systems, which may operate simultaneously or nearly simultaneously with each other.

The method 500 can begin by isolating 501 one or more fluids and a supply of wipes from each other. Next, the method 500 advances to responding 502 to initiation of a wipe dispensing event. The response 502 can include pressurization of one or more fluids that are each stored in a respective fluid chamber in isolation from each other. Such pressurization can be in addition to pressurization of the fluid that naturally occurs as a result of a static pressure head imposed on the fluid by gravity. At about the same time, or subsequent to, the pressurization 502 of the fluid in the fluid chamber, an associated fluid reservoir can be isolated 504 so that the pressurized fluid does not reenter the fluid reservoir.

When the fluid reservoir has been isolated 504, the pressurized fluid can then be directed 506 out of a nozzle and then dosed 508 directly onto a wipe and/or directed into a mixing bowl where the fluid can then come into contact with the wipe. In either case, the fluid exiting 506 the nozzle can be mixed 507 with one or more other fluids prior to dosing 508 of a wipe and/or as part of the dosing process. That is, the fluid(s) can each be dosed individually onto the wipe, or the fluids can first be mixed together and the mixture of fluids then dosed 508 onto the wipe. As well, the dosing 508 process can be performed substantially simultaneously with dispensation of the wipe such that the dosing 508, with one or more fluids, occurs at the point of dispensing of the wipe. That is, mixing of the fluid takes place on-demand as the wipe is dispensed, and not before. Finally, dispensation and dosing of the wipe can be performed as a single action by a user.

As a result of the dosing 508 of the wipe, any remaining fluid in the fluid conduit that has not been dosed 508 onto the wipe is depressurized 510. After depressurization, any remaining fluid may be pressurized, if at all, only by static pressure head imposed on the fluid by gravity. Contemporaneously with the depressurization 510, fluid flow between a fluid reservoir and a fluid chamber can be reestablished 512 so that the fluid chamber can be refilled 514 in preparation for the next wipe dispensing event.

F. Example Wipe Materials and Fluid Chemistries

In connection with embodiments such as those disclosed herein, a variety of different wipe substrate materials and dosing fluids can be employed. The scope of the invention is not limited to any particular substrate materials, dosing fluids, or combinations of these and, as such, the substrate materials and fluids discussed below are provided only by way of illustration, and not limitation.

Some general examples of wipe substrates include one or more of the following, in any combination: dry (un-dosed); wet (pre-dosed); dry (pre-dosed); wet or dry pre-dosed with fluid(s) and/or particles; synthetic; non-synthetic, such as cellulose for example; and, blends of synthetic and non-synthetic. Some particular embodiments of the invention allow the use of, for example, cellulose wipes with oxidants that are currently not possible due to chemical and/or wipe degradation.

As noted herein, embodiments of the invention may be advantageous in that, for example, the wipe dispensing system enables new chemistry that can be delivered onto a surface by a wipe. The chemical combinations are enabled as the fluids are mixed as the wipe is dispensing, therefore the fluids are in contact with each other for a substantially shorter period of time than in the case of traditional wet wipes.

In addition, embodiments of the invention implement the separation of both fluids from the wipe until the time that the wipe is dispensed. As a result, the problem of modification of the fluid when stored with the wipe over a long period of time is avoided. As an example, sodium hypochlorite exhibits higher stability at a relatively high pH. However, the micro efficacious profile of sodium hypochlorite is lower at the higher pH. Thus, example embodiments of the invention enable the activation of stable sodium hypochlorite into the less stable, yet highly efficacious, hypochlorous acid.

Sample Formula 1:

| Fluid A | | |
|---|---|---|
| Ingredient | Examples | Range of Wt % Active |
| Alkali Hypochlorite | Sodium Hypochlorite | 0.20-1.0% |
| Alkaline Buffer | Sodium Carbonate, Sodium Hydroxide | 0.01-1.0% |
| Water DI | | Balance |

| Fluid B | | |
|---|---|---|
| Ingredient | Examples | Range of Wt % Active |
| pH Regulators | Sodium Citrate, Citric Acid Anhydrous, Succinic Acid | 0.20-1.5% |
| Organic Slashing Agent | Sodium Citrate Dihydrate, Citric Acid Anhydrous, Succinic Acid | 0.30-0.90% |
| Surfactants/ Hydrotropes | Sodium Xylene Sulfonate, Decyl (Sulphophenoxy) Benzene Sulphonic Acid, Disodium Salt | 0-2.0% |
| Fragrance | | 0-0.10% |
| Water DI | | Balance |

Sample Formula 2:

| Fluid A | | |
|---|---|---|
| Ingredient | Examples | Range of Wt % Active |
| Alkali Hypochlorite | Sodium Hypochlorite | 0.20-1.0% |
| Alkaline Buffer | Sodium Carbonate, Sodium Hydroxide | 0.01-1.0% |
| Water DI | | Balance |

| Fluid B | | |
|---|---|---|
| Ingredient | Examples | Range of Wt % Active |
| Buffer | Sodium Bicarbonate | 0.10-1.0% |
| Inorganic Slashing Agent | Sodium Nitrite, Sodium Thiosulfate | 0.30-0.90% |
| Surfactants/ Hydrotropes | Sodium Xylene Sulfonate, Decyl (Sulphophenoxy) Benzene Sulphonic Acid, Disodium Salt | 0-2.0% |
| Fragrance | | 0-0.10% |
| Water DI | | Balance |

Sample Formula 3:

| Fluid A | | |
|---|---|---|
| Ingredient | Examples | Range of Wt % Active |
| Water DI | | 100% |

| Fluid B | | |
|---|---|---|
| Ingredient | Examples | Range of Wt % Active |
| Peracetic Acid | | 0.20-1.0% |
| Peroxide | Hydrogen Peroxide | 0.30-0.90% |
| Acetic Acid | | 2-5.0% |
| Surfactants/ Hydrotropes | Secondary Alkane Sulfonates, Alcohol Ethoxylates, EO/PO Surfactants | 0-2.0% |
| Solvent | Monohydric Alcohols | 0-2.0% |
| Fragrance | | 0-0.10% |

Alternatives to the described fluid components above are an oxidant in one fluid reservoir, with organic components in a water based fluid in a second fluid reservoir. Example organic component include, but are not limited to fragrances, surfactants, and polymers. Another multi-fluid combination that is enabled by example embodiments of the invention is chemistry that is stable as a concentrate but desired use is as a diluted version.

It should be noted that as used here, the term 'fluid' is intended to be broad in scope. As such, that term embraces any material, and any combination of two or more materials, that can be employed by a fluid dispensing system, examples of which are disclosed herein. Moreover, materials of various viscosities and other properties can be used. As such, examples of materials include fluids having a room temperature viscosity about the same as water, as well as lotions, slurries, soaps, ointments, and other materials whose room temperature viscosity may be greater than that of water.

Where combinations of materials are employed in an embodiment, any ratio or percentage of those materials can be employed. By way of illustration, if two fluids are employed in an embodiment, the percentage (e.g., by volume) of the first fluid can be anywhere in the range of about 1% to about 99% and, accordingly, the percentage (e.g., by volume) of the second fluid can be anywhere in the range of about 99% to about 1%.

As will be apparent from the foregoing discussion and examples, the wipe dispensing system can be configured to dispense a fluid combination whose pH is different from the respective pH values of the constituent components. For example, where one of the components is a relatively stable bleach, that component can be combined with one or more other fluids at about the time that dispensation of the wipe is initiated. The combined fluid thus produced can have a pH that renders it more active than the bleach component alone.

G. Example Alternative Embodiments

Figure 8:
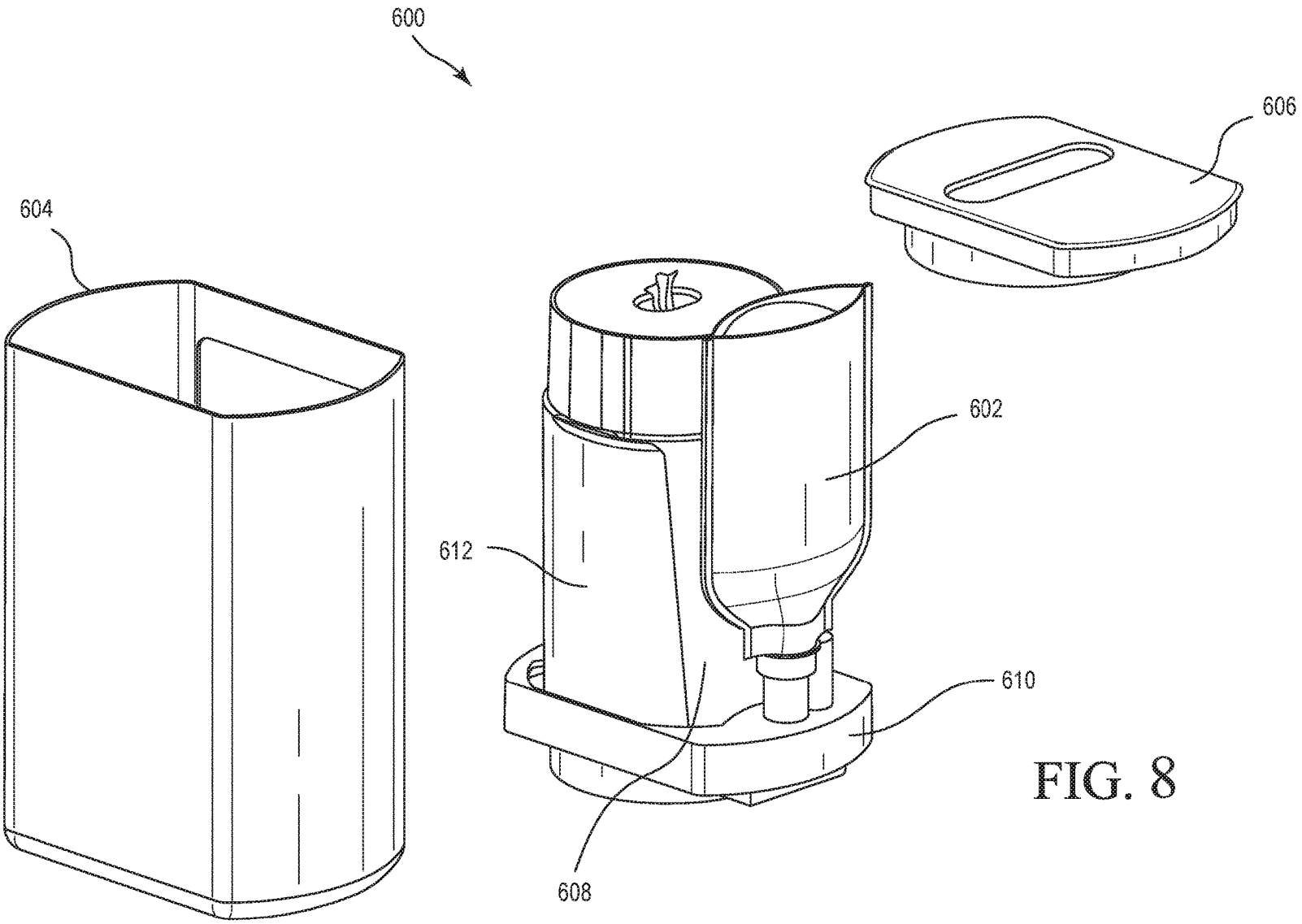
FIG. 8 discloses aspects of an alternative embodiment of a wipe dispensing system that includes only a single fluid reservoir.

With attention now to FIG. 8, details are provided concerning an example alternative embodiment. In general, the alternative embodiment may have the same principles of operation of the embodiment of FIGS. 1-7. The primary difference between the embodiments is that the alternative embodiment is limited to a single fluid reservoir, while the embodiment of FIGS. 1-7 includes multiple fluid reservoirs. As such, only selected differences between the embodiments are discussed below.

With particular regard now to FIG. 8, and example wipe dispensing system 600 is disclosed that includes only a single fluid reservoir 602. As shown, the fluid reservoir 602, along with other components of the wipe dispensing system 600 can be enclosed by a housing 604. A removable lid 606 can be provided that releasably engages the housing 604. A mixing bowl frame 608 and a pump frame 610 can operate to cause the discharge of fluid from the fluid reservoir 602 into a mixing bowl (not shown) that communicates with a portion of the housing 604 where a supply of wipes 612 is stored. The wipes 612 can thus be dosed in a manner similar to that disclosed in connection with the other embodiments disclosed herein.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed:

1. A wipe dispensing system comprising:

a housing that defines an internal wipe storage area;

a mixing bowl having an opening that communicates with the wipe storage area;

first and second fluid reservoirs disposed within the housing and isolated from the wipe storage area, wherein the first and second reservoirs are isolated from each other so that fluid in one reservoir cannot enter the other reservoir;

a resistance element disposed in the opening defined by the mixing bowl such that dispensation of a wipe from the wipe storage area causes the second motion of a mixing bowl frame so that the wipe is dosed by the first and second fluids as the wipe is dispensed;

first and second pumps in communication with the first and second fluid reservoirs, respectively;

first and second nozzles in communication with first and second pumps, respectively, and the first and second nozzles are located proximate the opening of the mixing bowl such that respective outlets of the first and second nozzles are in communication with the opening of the mixing bowl; and the first and second pumps respond to initiation of the dispensation of a wipe from the wipe dispensing system wherein a mixing bowl frame is operably connected with the first and second pumps such that a first motion of the mixing bowl frame corresponds to a suction operation of each of the pumps and a second motion of the mixing bowl frame corresponds to a discharge operation of each of the pumps, and the mixing bowl that is integrated with the mixing bowl frame.

2. The wipe dispensing system as recited in claim 1, wherein the mixing bowl frame is biased to a position corresponding to the pump suction operation.

3. The wipe dispensing system as recited in claim 1, further comprising:

a supply of wipes disposed in the wipe storage area;

a first fluid disposed in the first fluid reservoir; and a second fluid disposed in the second fluid reservoir, wherein, a combination of the first and second fluids is efficacious for a relatively shorter period of time than the first and second fluids employed separately from each other, and wherein the first and second fluids retain their potency for a relatively longer period of time when stored separately from each other than when combined with each other.

4. The wipe dispensing system as recited in claim 3, wherein:

each of the wipes in the supply of wipes comprises one of the following substrates: dry (un-dosed); wet (pre-dosed); dry (pre-dosed); wet or dry pre-dosed with fluid(s) and/or particles; synthetic material; non-synthetic material; or, a blend of synthetic and non-synthetic materials;

the first fluid comprises one of deionized water, sodium hypochlorite, or sodium carbonate; and the second fluid comprises one of deionized water, sodium citrate dehydrate, citric acid anhydrous, succinic acid, sodium xylene sulphonate, decyl (sulphophenoxy) benzene sulphonic acid, disodium salt, or Frimenich Fresh Blue 449607B.

* * * * *